US007975587B2

(12) United States Patent
Schneider

(10) Patent No.: US 7,975,587 B2
(45) Date of Patent: Jul. 12, 2011

(54) PUNCHING TOOL

(75) Inventor: Albrecht Schneider, Oberursel (DE)

(73) Assignee: Mate Precision Tooling Inc., Anoka, MN (US)

( * ) Notice: Subject to any disclaimer, the term of this patent is extended or adjusted under 35 U.S.C. 154(b) by 295 days.

(21) Appl. No.: 10/540,913

(22) PCT Filed: Dec. 30, 2003

(86) PCT No.: PCT/US03/41495

§ 371 (c)(1),
(2), (4) Date: Jun. 29, 2005

(87) PCT Pub. No.: WO2004/060620

PCT Pub. Date: Jul. 22, 2004

(65) Prior Publication Data

US 2006/0048623 A1 Mar. 9, 2006

(30) Foreign Application Priority Data

Dec. 30, 2002 (DE) ..... 102 61 748

(51) Int. Cl.
*B26F 1/14* (2006.01)

(52) U.S. Cl. ..... 83/684; 83/698.11; 83/698.91

(58) Field of Classification Search ..... 83/698.91, 83/686, 684, 698.31, 698.71, 698.61, 698.11, 83/699.51, 699.61, 667; 72/482.91, 482.2; 279/79

See application file for complete search history.

(56) References Cited

U.S. PATENT DOCUMENTS

| | | | | |
|---|---|---|---|---|
| 2,172,272 A | | 9/1939 | Booth | |
| 2,245,676 A | * | 6/1941 | Johnson | 279/89 |
| 2,974,967 A | * | 3/1961 | Felmet | 279/89 |
| 3,079,824 A | * | 3/1963 | Schott | 83/140 |
| 3,600,999 A | * | 8/1971 | Daniels | 83/686 |

(Continued)

FOREIGN PATENT DOCUMENTS

| | | |
|---|---|---|
| FR | 2 607 737 | 6/1988 |
| FR | 2 641 486 | 7/1990 |

OTHER PUBLICATIONS

Supplementary European Search Report for European Patent Application No. 03 80 0286, Sep. 28, 2009, European Patent Office, Munich, Germany.

*Primary Examiner* — Boyer D Ashley
*Assistant Examiner* — Omar Flores-Sánchez
(74) *Attorney, Agent, or Firm* — Stites & Harbison PLLC; Marvin Petry; Stephen J. Weyer

(57) ABSTRACT

A punching tool has a guided, axially displaceable die plunger, which is fixed against relative rotation, in a guide bushing. In a bore in its front end a punching die is seated. During the punching stroke the punching die rests against a front face of the die plunger and is axially fixed in place by means of one or several snap-in balls each of which is seated in a transverse bore, which snap-in balls are maintained in engagement with an annular groove by means of a resilient ring in the die plunger. The outer diameter of the resilient ring is only slightly less in the engagement position than the inner diameter of the guide bushing and can be resiliently widened for releasing the punching die outside of the guide bushing.

24 Claims, 1 Drawing Sheet

U.S. PATENT DOCUMENTS 3,628,231 A 12/1971 Pancook
3,791,756 A * 2/1974 Johnson ..... 408/139
3,958,476 A * 5/1976 Bartha ..... 83/143
4,007,653 A * 2/1977 Cady ..... 83/140
4,141,264 A 2/1979 Weisbeck
4,440,052 A 4/1984 Weisbeck
5,037,254 A 8/1991 Asberg
5,054,347 A 10/1991 Johnson et al.
5,131,303 A * 7/1992 Wilson et al. ..... 83/140
5,528,963 A * 6/1996 Wei ..... 81/63
5,752,424 A 5/1998 Rosene et al.
5,816,093 A * 10/1998 Takeuchi et al. ..... 72/327
5,884,546 A 3/1999 Johnson
5,954,463 A * 9/1999 Jore ..... 408/239 R
6,047,621 A * 4/2000 Dries et al. ..... 83/136
6,135,462 A * 10/2000 Robison ..... 279/137
6,276,247 B1 8/2001 Helda
6,457,916 B2 * 10/2002 Wienhold ..... 408/240
6,463,839 B2 10/2002 Ohtsuka et al.

* cited by examiner

PUNCHING TOOL

FIELD OF THE INVENTION

The invention relates to a punching tool having a die plunger guided during axially displacement but fixed against relative rotation, in a guide bushing and having a bore in the front end, in which a punching die can be axially fixed by its shaft which is provided with an annular groove, by means of holding elements which releasably engage the annular groove.

BACKGROUND OF THE INVENTION

Such a punching tool with releasable locking against axial relative movements between the punching die and the die plunger is known from French Patent No. 2 641 486 A1. There, three screws acting as holding elements, which are radially screwed into corresponding transverse threaded bores in the die plunger, engage with rounded, hardened ends an annular groove in the shaft of the punching die. The screws fix the punching die axially on the die plunger and absorb the forces occurring on the punching die in the course of the punching stroke, as well as during the return stroke, and transfer them to the die plunger. Since in this case the stressed surfaces are very small, the known punching tool cannot absorb large punching forces. Moreover, changing of the punching tool is very awkward, since several screws must be removed and screwed back in again to accomplish this.

Furthermore, punching tools with releasable locking against relative rotating movements between the punching die and the die plunger are known from U.S. Pat. Nos. 2,172,272 and 5,131,303. Such locking to prevent movements in both directions of rotation is necessary because the punching die is connected with the die plunger by a screw thread, which transmits the axial loads occurring during punching from the punching die to the die plunger and permits a compensation of the total length of the punching die and the die plunger after re-grinding. To prevent a relative rotating movement of the two threaded elements, and therefore a change of the total length, the exterior thread is cut by several axial longitudinal grooves distributed over the circumference, and a pointed pin, seated in a transverse bore of the screw thread element with the interior screw thread, is pushed into one of the longitudinal grooves by a spring washer. In U.S. Pat. No. 5,131,303, the pointed pin is embodied as one piece with a spring washer and is prevented from a radial backing movement out of the longitudinal groove in that the bore wall of the guide bushing blocks a widening of the spring washer. Basically the locking must absorb the loads in both directions of rotation. If the spring washer is outside of the bore in the guide bushing, a relative rotation of the screw thread elements is possible, wherein it is necessary for releasing and renewed connecting of the punching die with the die plunger to overcome the rotary locking several times in the course of each revolution.

SUMMARY OF THE INVENTION

The Object of the invention is based on creating a punching tool of the type described which provides secure locking by means of holding members against axial relative movements between the punching die and the die plunger, which permits a simple and rapid separation of the punching die from the die plunger, and wherein the large forces occurring in the course of the punching stroke are kept away from the holding members.

The above object is attained in accordance with the present invention in that during the punching stroke the punching die rests against a front face of the die plunger and can be axially fixed in place by means of one or several holding members in the form of snap-in balls, each of which is seated in a transverse bore in the front end of the plunger, and which are maintained in engagement with the annular groove by means of resilient ring whose outer diameter is less in the engagement position than the inner diameter of the guide bushing and which can be widened to a diameter greater than the inner diameter of the guide bushing when the punching die is removed from the die plunger.

The novel punching tool initially offers the advantage that the strong loads during the punching stroke are transmitted via the front face of the die plunger, so that the holding members need not be correspondingly strong. The snap-in balls and their guide faces are only stressed by the considerably lesser forces during the return stroke of the punching die. The resilient ring also needs to exert only a minimal spring force on the snap-in balls in order to prevent the punching die from falling out of the bore in the die plunger outside of the guide bushing. Therefore the punching die can be easily separated from the die plunger or, vice versa, pushed into the bore in the front end of the die plunger and locked there. Regardless of the small or minimal spring force with which the resilient ring pushes the snap-in balls into the annular groove, the proposed locking against axial separation of the punching die from the die plunger is absolutely dependable as long as it is provided by means of a suitable selection of the diameters that the snap-in balls still engage the annular groove when the resilient ring rests against the bore wall of the guide bushing.

To keep axial play in the locking as low as possible, it is provided in a preferred embodiment of the invention that in the engaged position the outer diameter of the resilient ring is only minimally less than the inner diameter of the guide bushing.

Also, in view of dependability of the locking, the resilient ring is usefully made of steel. It has furthermore been shown to be advantageous if the resilient ring is seated in an annular groove in the circumferential surface of the die plunger which crosses the center longitudinal axes of the transverse bores and is only slightly wider than the diameter of the resilient ring in axial section.

In the preferred embodiment of the invention, the axial support of the forces during the punching stroke is provided in that the shaft of the punching die is formed with a flange or collar whose rear rests against the front end face of the die plunger. However, alternatively the rear end face of the shaft of the punching die could also rest on the bottom of the bore in the front end of the die plunger. The front end face of the die plunger enclosing the bore on which the back of a flange could be axially supported on the die plunger, as well as the bottom of the bore in the front end of the die plunger, each constitute a portion of the entire front face of the die plunger, which is also understood here to be all faces facing forward toward the punching die, provided they are not created by undercuts.

To assure axial freedom from play, in a useful embodiment of the invention the distance between the transverse plane in which the center longitudinal axes of the transverse bores are located, and the front end face of the die plunger, or of the bottom of the bore, is of such a size in relation to the distance between the central transverse plane through the annular grove and the back of the flange, or of the rear end face of the shaft of the punching die, that the punching die can be pressed axially against the die plunger by means of the spring-loaded snap-in balls.

In many applications, the contour of the cutting edge of the punching die has a shape which differs from a circle. It is necessary in such cases to maintain not only the die plunger, but also the punching die, at a defined angle of rotation with respect to the central longitudinal axis of the bore of the guide bushing. To this end, the shaft of the punching die is preferably provided behind the annular groove with an open elongated groove which is open at the rear end of the shaft, into which a transverse pin matching the width of the longitudinal groove and seated in the die plunger can be inserted into the bore in the die plunger when the punching die is inserted. In this case the transverse pin preferably projects radially outward from the die plunger into a longitudinal groove of matching width in the guide bushing. In this way the die plunger is oriented in the circumferential direction and fixed in place with respect to the guide bushing, the same as the punching die is fixed in place with respect to the die plunger.

BRIEF DESCRIPTION OF THE DRAWINGS

The invention will now be described with respect to preferred embodiments thereof wherein.

DETAILED DESCRIPTION OF THE PREFERRED EMBODIMENTS

Figure 1:
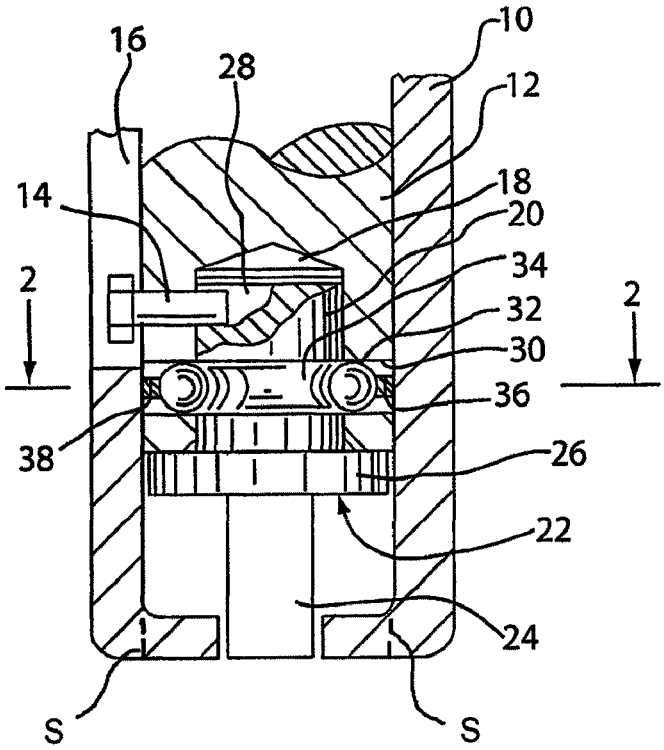
FIG. 1 is a longitudinal sectional view through the front end of a guide bushing containing the features of the present invention.
Figure 2:
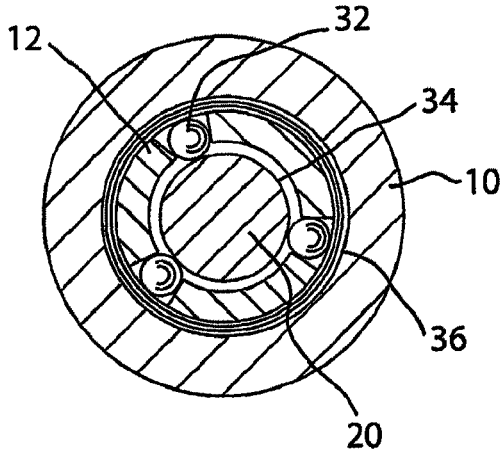
FIG. 2 is a cross sectional view taken along line 2-2 of FIG. 1.

An exemplary embodiment of the invention will be explained in greater detail with reference to the accompanying figures. FIG. 1 shows a simplified longitudinal section through the front end of a guide bushing and of a die plunger guided therein, as well as a punching die connected thereto.

The guide bushing 10 can be a conventional guide bushing such as is used, for example, in connection with a conventional punching press. The guide bushing 10 is inserted into the tool receiver of the punching press in an angle of rotation positioned in relation to its central longitudinal axis, which is for example determined by an exterior longitudinal groove in the guide bushing, and is fixed in this position. It is not important for the present invention how the upper end of the guide bushing is connected with the other components of the punching tool. An exchangeable stripper plate may be attached to the lower end as represented by dotted lines S in FIG. 1. In the exemplary embodiment shown, for the sake of simplicity the portion of the punching tool used as a stripper is shown as being of one piece with the guide bushing 10.

A die plunger 12 is guided during axial displacement, but fixed against rotation relative to the guide bushing 10. Die plunger 12 transmits the pressure and pulling forces exerted on its upper end for performing the punching stroke and the return stroke. The fixation against rotation relative to guide bushing 10 takes place in the customary way by means of a transverse pin 14 seated in the front area of the die plunger 12, which projects radially and wherein its front end slides in a longitudinal groove 16, which matches its width and is open at the end of the guide bushing 10. The longitudinal groove 16 can be the same longitudinal groove which fixes the angle of rotation of the guide bushing with respect to the punching press, but it can also be a separate groove independent of the former.

The die plunger 12, which is circular in cross section, is provided at its front end with a concentric bore 18, which is used for receiving the rear of shaft 20, which matches the diameter of a punching die identified as a whole by 22. The latter moreover has a front shaft 24 whose cross section, for example circular or polygonal, corresponding to the holes to be punched, is provided with a flange or collar 26 in its central area, and in the assembled state rests with its back against the front end face of the die plunger 12 during the punching stroke, so that the punching force is transmitted from the die plunger 12 to the punching die 22 through these cooperating faces.

To assure fixation in an angle of rotation which is defined with respect to its central longitudinal axis and is important in connection with a punching die 22 of polygonal or non-circular cross section of the front shaft 24, the transverse pin 14 is arranged in such a way that it projects radially inward into the bore 18 near the inner end of the latter. The rear shaft 20 of the punching die 22 is provided on at least one location of its circumference near its rear end with a longitudinal groove 28, which matches the width of the transverse pin 14 and is open at its outer end. The punching die 22 must be introduced into the bore 18 in such a way that the inner end of the transverse pin 14 enters the groove, or a defined longitudinal groove 28, and in the engaged position maintains the punching die 22 fixed against relative rotation with respect to the die plunger 12.

Figure 3:
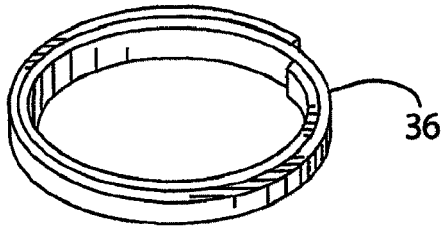
FIG. 3 is a perspective view of an element of FIGS. 1 and 2.

In the course of inserting the punching die 22 in the bore 18, three snap-in balls 32, each of which is seated in a transverse bore 30 in the front end of the die plunger 12, snap into an annular groove 34 in the rear of shaft 20 of the punching die 22 immediately prior to reaching the axial end position in which the rear of the collar 26 rests against the front end face of the die plunger 12. The snap-in balls 32 are urged radially inward by a resilient ring 36 made of steel or other elastic material, which surrounds them but, because of a slight inward taper f the transverse bores 30 in the area of their outlet into the bore 18, the are prevented from falling out of the transverse bores 30 after the punching die 22 has been pulled out of the bore 18 of the die plunger 12. The axial position of the transverse bores 30, whose diameter matches the diameter of the snap-in balls 32, in relation to the front end face of the die plunger 12, and the axial position of the annular groove 34 in relation to the rear face of the collar 26, have been selected to be such that in the assembled state represented in the figures the collar 26 rests against the front end face of the die plunger 12, and at the same time the snap-in balls 32 enter as far as possible into the annular groove 34. In this position resilient ring 36 takes up a substantially concentric position with respect to the punching die 22 between the snap-in balls 32 and the bore wall of the guide bushing 10. In this case the radial distance between the resilient ring 36 and the bore wall should be as short as possible in order to minimize a radial deflection movement of the snap-in balls 32 and a corresponding axial movement of the punching die 22 with respect to the die plunger 12 during the transition from the punching stroke to the return stroke. The resilient ring 36 is seated in an annular groove 38, the width of which matches its height, in the die plunger 12, whose central plane coincides with the transverse plane in which the central longitudinal axes of the transverse bores 30 are located. The resilient ring 36 is preferably a spiral spring having several turns, as best shown in isolation in FIG. 3.

As long as the front end of the die plunger 12 is located in the guide bushing 10, the punching die 22 is maintained unreleasably in the bore 18 by the snap-in balls 32. The balls 32 cannot radially exit the annular groove 34, because they would have to widen the resilient ring 36 beyond the limits of its radial expansion to do this. But the resilient ring 36 can only be minimally widened until it engages the bore wall of the guide bushing 10. Thus, in the assembled state the fastening arrangement shown and described here represents an absolutely dependable, positive locking, which is relieved at one end, so that large punching forces can also be transmitted.

On the other hand, the described fastening arrangement permits a very rapid and simple removal and exchange of one punching die 22 for another. As soon as the front end of the die plunger 12 has moved downwardly out of the front end of the guide bushing 10, the resilient ring 36 maintaining the snap-in balls 32 in their inner end position can easily be deflected radially outward when the punching die 22 is pulled out of the front end of the bore 18 by a manual pull and in the process the snap-in balls 32 are radially urged out of the annular groove 34. In the process the resilient ring 36 maintains the snap-in balls 32 in their transverse bores 30 and, following the removal of the punching die 22, urges them into their radially inner end position against the tapered inner opening of the transverse bores 30. Also, during insertion of a new punching die 22 into the bore 18 outside of the guide bushing 10, the snap-in balls 32 can initially be deflected radially outward while the resilient ring 36 is widened, before they snap into the annular groove 34 directly ahead of reaching the represented end position, in the course of which the diameter of the resilient ring 36 is reduced until it again fits into the bore of the guide bushing 10.

It is understood that, differing from the above description of the exemplary embodiment, more or fewer than three snap-in balls 32 can be provided. With smaller diameters of the die plunger 12 in particular it could also be imagined that the punching force is not transmitted via a collar 26, but instead via the rear end face of the punching die 22. In this case that part of the front face of the die plunger 12 formed by the bottom of the bore 18 would have to be designed in such a way that a sufficiently large support face for the rear end of the punching die 22 results.

It is furthermore understood that, in place of a single transverse pin 14 for aligning the punching die 22 and the die plunger 12 with respect to the guide bushing 10, two separate transverse pins could be used in order to align the punching die 22 in relation to the die plunger 12 on the one hand and, on the other, to align the latter in relation to the guide bushing 10.

All above mentioned embodiment variations have the advantage that it is possible to achieve the advantages described by means of a very small punching die as the only easily exchangeable wear element.

Although the invention has been described with respect to preferred embodiments, it will be appreciated that the invention is capable of numerous modifications and variations apparent to those skilled in the art without departing from the spirit and scope of the invention.

The invention claimed is:

1. A punching tool, having a guided, axially displacable die plunger, which is fixed against relative rotation, in a guide bushing and having a bore in the front end in which a punching die can be axially fixed, the punching die provided with an annular groove, the punching die having a punch die longitudinal groove into which a transverse pin can be inserted, wherein the diameter of the pin matches the width of the punch die longitudinal groove, holding elements located in transverse bores in the die plunger, which holding elements releasably engage the annular groove, wherein during the punching stroke the punching die rests against a front face of the die plunger and can be axially fixed in place by said holding elements which are maintained in engagement with the annular groove by means of a resilient ring, the outer diameter of which resilient ring is less in the engagement position than the inner diameter of the guide bushing and which resilient ring can be widened to a diameter greater than the inner diameter of the guide bushing when the die plunger is removed from the guide bushing.

2. A punching tool in accordance with claim 1, wherein the transverse pin projects radially outward out of the die plunger into a guide bushing longitudinal groove located in the guide bushing.

3. A punching tool in accordance with claim 1, wherein in the engagement position the outer diameter of the resilient ring engages the inside of the guide bushing.

4. A punching tool in accordance with claim 1, wherein the resilient ring is made of steel.

5. The punching tool in accordance with claim 1, wherein the ends of the transverse bores facing the annular groove are tapered inwardly so as to prevent the holding elements from coming out of the transverse bores when the punching die is not in the die plunger.

6. The punching tool in accordance with claim 1, wherein the holding elements are balls which are of such a diameter as to snap fit into the annular groove.

7. The punching tool in accordance with claim 1, wherein, in the widened condition of the resilient ring, the force of the holding elements on the punching die is reduced so as to allow axial removal of the punching die from the die plunger.

8. A punching tool, having a guide bushing, a die plunger axially displaceable in the guide bushing and being fixed against rotation relative to the guide bushing, the die plunger having a bore in the front end in which a punching die can be axially fixed, the guide bushing having an openable front end through which the punching die can be inserted and removed the punching die provided with an annular groove, holding elements located in transverse bores in the die plunger, which holding elements releasably engage the annular groove, wherein during the punching stroke the punching die rests against a front face of the die plunger and can be axially fixed in place by said holding elements which are maintained in engagement with the annular groove by means of a resilient ring, the die plunger including a further annular groove located in the outer circumferential surface of the die plunger and intersecting the transverse bores, the resilient ring being located within the further annular groove, wherein when the die plunger is within the guide bushing, the resilient ring is forced inwardly by its engagement with the inside wall of the guide bushing with sufficient force to cause the holding elements to engage the annular groove to secure the punching die in the die plunger, and wherein when the lower end of the die plunger is moved out of the guide bushing through the said openable front end, the resilient ring expands to release the holding elements enough to permit removal of the punching die from the die plunger.

9. A punching tool in accordance with claim 8, wherein in the engagement position the outer diameter of the resilient ring engages the inside of the guide bushing.

10. A punching tool in accordance with claim 8, wherein the resilient ring is made of steel.

11. A punching tool in accordance with claim 8, wherein the shaft of the punching die is formed with a flange, the rear of which rests against the front end face of the die plunger.

12. A punching tool in accordance with claim 11, wherein the distance between the transverse plane in which the longitudinal axes of the transverse bores are located and the front end face of the die plunger is of such a size in relation to the distance between the central transverse plane through the annular groove in the punching die and the back of the flange that the punching die can be pressed axially against the die plunger by means of the holding elements.

13. A punching tool in accordance with claim 8, wherein the rear end face of the punching die rests against the bottom of the said bore in the die plunger.

14. A punching tool in accordance with claim 13, wherein the distance between the transverse plane in which the longitudinal axes of the transverse bores are located and the bottom of the bore is of such a size in relation to the distance between the central transverse plane through the annular groove in the punching die and the rear end face of the punching die that the punching die can be pressed axially against the die plunger by means of the holding elements.

15. A punching tool in accordance with claim 8, wherein the punching die is further provided with a punch die longitudinal groove into which a transverse pin can be inserted, wherein the diameter of the pin matches the width of the punch die longitudinal groove.

16. A punching tool in accordance with claim 15, wherein the transverse pin projects radially outward out of the die plunger into a guide bushing longitudinal groove located in the guide bushing.

17. The punching tool in accordance with claim 8, wherein the ends of the transverse bores facing the annular groove are tapered inwardly so as to prevent the holding elements from coming out of the transverse bores when the punching die is not in the die plunger.

18. The punching tool in accordance with claim 8, wherein the holding elements are balls which are of such a diameter as to snap fit into the annular groove.

19. The punching tool in accordance with claim 18, wherein in the engagement position the outer diameter of the resilient ring engages the inside of the guide bushing.

20. The punching tool in accordance with claim 18, wherein the resilient ring is made of steel.

21. The punching tool in accordance with claim 18, wherein the shaft of the punching die is formed with a flange, the rear of which rests against the front end face of the die plunger.

22. The punching tool in accordance with claim 18, wherein the rear end face of the punching die rests against the bottom of the said bore in the die plunger.

23. The punching tool in accordance with claim 18, wherein the punching die is further provided with a punch die longitudinal groove into which a transverse pin can be inserted, wherein the diameter of the pin matches the width of the punch die longitudinal groove.

24. The punching tool in accordance with claim 18, wherein the ends of the transverse bores facing the annular groove are tapered inwardly so as to prevent the balls from coming out of the transverse bores when the punching die is not in the die plunger.

* * * * *